US010815718B2

(12) United States Patent
Schweiss

(10) Patent No.: US 10,815,718 B2
(45) Date of Patent: Oct. 27, 2020

(54) OVERHEAD BI-FOLD DOOR

(71) Applicant: Michael L. Schweiss, Fairfax, MN (US)

(72) Inventor: Michael L. Schweiss, Fairfax, MN (US)

(73) Assignee: SORREL 2UARTERS, LLC, Hector, MN (US)

( * ) Notice: Subject to any disclaimer, the term of this patent is extended or adjusted under 35 U.S.C. 154(b) by 380 days.

(21) Appl. No.: 15/940,628

(22) Filed: Mar. 29, 2018

(65) Prior Publication Data

US 2018/0283084 A1 Oct. 4, 2018

Related U.S. Application Data

(60) Provisional application No. 62/601,884, filed on Apr. 4, 2017.

(51) Int. Cl.

| | |
|---|---|
| ***E06B 3/01*** | (2006.01) |
| ***E05D 15/26*** | (2006.01) |
| ***E05F 15/605*** | (2015.01) |
| *E05F 15/686* | (2015.01) |
| *E06B 3/48* | (2006.01) |
| *E06B 3/70* | (2006.01) |

(52) U.S. Cl.

CPC ..... *E06B 3/01* (2013.01); *E05D 15/262* (2013.01); *E05F 15/605* (2015.01); *E05F 15/686* (2015.01); *E05Y 2201/654* (2013.01); *E05Y 2201/672* (2013.01); *E05Y 2900/106* (2013.01); *E05Y 2900/108* (2013.01); *E06B 3/485* (2013.01); *E06B 2003/7044* (2013.01)

(58) Field of Classification Search

CPC .... E06B 3/01; E06B 3/485; E06B 2003/7044; E05F 15/605; E05F 15/686; E05D 15/262

See application file for complete search history.

(56) References Cited

U.S. PATENT DOCUMENTS

| | | | | |
|---|---|---|---|---|
| 1,216,202 A * | 2/1917 | Boughton | ..... | E05F 15/686 49/200 |
| 1,669,990 A * | 5/1928 | Mantz | ..... | E05D 13/1276 16/198 |
| 2,136,611 A | 11/1938 | Cooper | | |
| 2,308,150 A | 1/1943 | Liss | | |
| 3,024,838 A | 3/1962 | Egleston et al. | | |
| 4,026,343 A | 5/1977 | James | | |

(Continued)

*Primary Examiner* — Katherine W Mitchell
*Assistant Examiner* — Abe Massad
(74) *Attorney, Agent, or Firm* — Richard John Bartz

(57) ABSTRACT

An overhead bi-fold door mounted on a freestanding header has a door lift device with polymer cylindroids and capstans operated with an electric motor driven power transmission to selectively move the bi-fold door from an upright closed position to a folded open position and allow the bi-fold door to move from the folded open position to the upright closed position. Anchors mounted on the bi-fold door adjust the working length of the cylindroids between the capstans and anchors. The capstans have laterally spaced disks engageable with the cylindroids during the helical winding and unwinding of the cylindroid on the capstans as the bi-fold door moves at an increasing rate of speed from the upright closed to folded open positions and a decreasing rate of speed from the folded open to upright closed positions.

20 Claims, 9 Drawing Sheets

(56) References Cited

U.S. PATENT DOCUMENTS

| | | | | |
|---|---|---|---|---|
| 4,067,545 | A * | 1/1978 | Singer | B61B 11/004 104/173.2 |
| 4,261,409 | A | 4/1981 | Devore | |
| 4,637,446 | A | 1/1987 | McQueen | |
| 4,760,622 | A * | 8/1988 | Rohrman | E05D 13/1207 16/196 |
| 4,765,093 | A | 8/1988 | Edwards | |
| 5,149,057 | A * | 9/1992 | Meurer | B01D 21/04 254/276 |
| 5,168,914 | A | 12/1992 | Keller | |
| 5,259,433 | A * | 11/1993 | Cloutier | E05D 13/14 160/190 |
| 5,343,923 | A | 9/1994 | Keller | |
| 5,560,658 | A | 10/1996 | Coolman et al. | |
| 5,628,356 | A * | 5/1997 | Marocco | E06B 9/308 160/170 |
| 6,199,617 | B1 | 3/2001 | Schweiss | |
| 6,547,292 | B1 | 4/2003 | Keller | |
| 6,866,080 | B2 | 3/2005 | Schweiss | |
| 7,029,041 | B2 | 4/2006 | Keller | |
| 7,219,711 | B2 | 5/2007 | Keller et al. | |
| 2008/0127560 | A1 * | 6/2008 | Harvey | E05F 15/686 49/199 |
| 2015/0376933 | A1 * | 12/2015 | Schweiss | E06B 1/12 49/339 |
| 2017/0328104 | A1 * | 11/2017 | Funk | E05D 13/1261 |

* cited by examiner

OVERHEAD BI-FOLD DOOR

CROSS REFERENCE TO RELATED APPLICATION

This U.S. application claims the benefit of U.S. Provisional Application Ser. No. 62/601,884 filed Apr. 4, 2017.

FIELD OF INVENTION

The overhead bi-fold door relates to the art of doors used to selectively open a doorway in a building or an enclosure. The bi-fold door has panels connected with hinges that allow the bi-fold door to be moved with lift devices from an upright closed position to a folded open position relative to the doorway to allow vehicles, equipment and persons to move through the doorway.

BACKGROUND OF THE INVENTION

Doors are used to open and close doorways in buildings. Common types of these doors are hinged doors horizontally sliding doors, overhead track doors and two piece center hinged doors known as bi-fold doors. The bi-fold doors have door lift devices operable to move the bi-fold doors from doorway closed positions to overhead folded doorway open positions. Examples of overhead bi-fold doors with electric motor driven door lift devices are disclosed in a number of U.S. patents. Examples of bi-fold door having door lift devices are described and incorporated herein.

Egleston et al in U.S. Pat. No. 3,024,838 discloses an overhead bi-fold door having pivotally connected upper and lower sections. Hinges connect the upper section of the bi-fold door to building structures. A door activating motor mechanism mounted on the building structure above the bi-fold door has three cables trained over guide pulleys and connected to the lower sectional of the bi-fold door. The cables wind on and unwind from a winch drum drivably connected to the motor mechanism to move the bi-fold door between closed and folded open positions.

DeVore in U.S. Pat. No. 4,261,409 discloses an overhead bi-fold door having pivotally connected upper and lower sections. Hinges pivotally connect the upper section of the bi-fold door to a building beam. A motor mounted on the building beam drives a roller chain connected to a cable to open and close the bi-fold door. The roller chain and cable do not wind around a winch drum.

D. N. Keller in U.S. Pat. Nos. 5,168,914 and 5,343,923 disclose overhead bi-fold doors having door lift mechanisms mounted on bottom members of the bi-fold doors. The lift mechanisms include a motor driven shaft connect to winch drums. Cables connected to upper members of the bi-fold door wind on and unwind from the winch drums to move the door from a closed position to a folded open position.

R. D. Keller in U.S. Pat. No. 7,029,041 discloses an overhead bi-fold door having door lift mechanisms including a motor driven shaft mounted on the bottom section of the bi-fold door. The shaft is connected to a winch drum accommodating a cable secured to an upper section of the bi-fold door. Rotation of the shaft turns the winch drum to wind and unwind the cable on the winch drum to move the bi-fold door between closed and folded open positions.

These bi-fold doors have opening and closing episodes that move the bi-fold doors at a constant speed determined by the rotational revolutions of the winch drums drive by the motors. The wire cables, known as aircraft cables, consist of strands steel wires that are twisted into a helix together to give the cable flexibility and strength. The wire cables are stressed by fluctuating bending and tension forces, wear, and corrosion. In use, wire cables require periodic adjustments and are subjected to wear and failure which reduces working life. Wire cables begin to fray when wrapped on lift drums of bi-fold door lift devices.

M. L. Schweiss in U.S. Pat. Nos. 6,199,617 and 6,866,080 devised a method and apparatus for opening and closing a bi-fold door that does not include the cables used in conventional bi-fold door opening and closing devices. The bi-fold door lifting device has motor driven winches operable to accommodate a plurality of elongated, wide, flat and flexible straps of non-elastic plastic and fiber materials. The bi-fold lifting device with the straps are efficient and quiet and have heavy duty and durable characteristics. The bi-fold door lift devices with straps have overcome the adjustment and maintenance requirements of bi-fold door wire cable lift devices for bi-fold doors. The straps are visible wide members that require large winches that take up space on the inside of the bi-fold door.

SUMMARY OF THE INVENTION

An overhead bi-fold door has upper and lower panels connect with hinges and movable between an upright closed position to an overhead folded position relative to a doorway of a building. The upper panel is connected with hinges to a freestanding header providing a doorway of a building or enclosure. Alternatively, the building or enclosure has a header over the doorway for supporting the hinges and bi-fold door. A lift device having cylindroids associated with capstans is operated to move the bi-fold door from the upright closed position to the overhead folded position and allow the bi-fold to move from the folded open position back to the upright closed position. The capstans are mounted on a shaft rotatably mounted on either the lower panel or upper panel of the bi-fold door. A power transmission operatively connected to the shaft is driven with a reversible electric motor to selectively rotate the shaft in opposite directions. The capstans have disks with flat surfaces that engage the cylindroids to maintain the cylindroids in helical coil patterns between the disks. The cylindroids comprise flexible cylindrical lines of elongated polymer synthetic fibers including nylon, polyester or polypropylene. The fibers are twisted into strands which are twisted or braided into a line. The polymer cylindroids have high tension strength, low stretch or elongated expansion, and good wear and weathering properties. The cylindroids are flexible and quietly wrap-up on the capstans. The speed or rate of movement of the bi-fold door increases as the bi-fold door moves from the upright closed position to the folded open position and slows down as the bi-fold door moves back from the folded open position to the upright closed position. Cylindroids have narrow cylindrical shapes that do not require large capstans that require large spaces on the inside of the bi-fold doors. Ratchet anchors mounted on the panel opposite the panel holding the lift devices accommodate the cylindroids. Ratchet anchors function to adjust the working lengths and take up the slack of the cylindroids whereby the cylindroids are subjected to substantially the same tension forces during movement of the bi-fold door from the upright closed position to the folded open position. The power transmissions include a brake mechanism that holds the bi-fold door in the folded open position. The electric motor is operable to release the brake mechanism to allow the bi-fold door to move from the folded open position back to the upright closed position.

DESCRIPTION OF THE BI-FOLD DOOR AND DOOR LIFT APPARATUS

Figure 1:
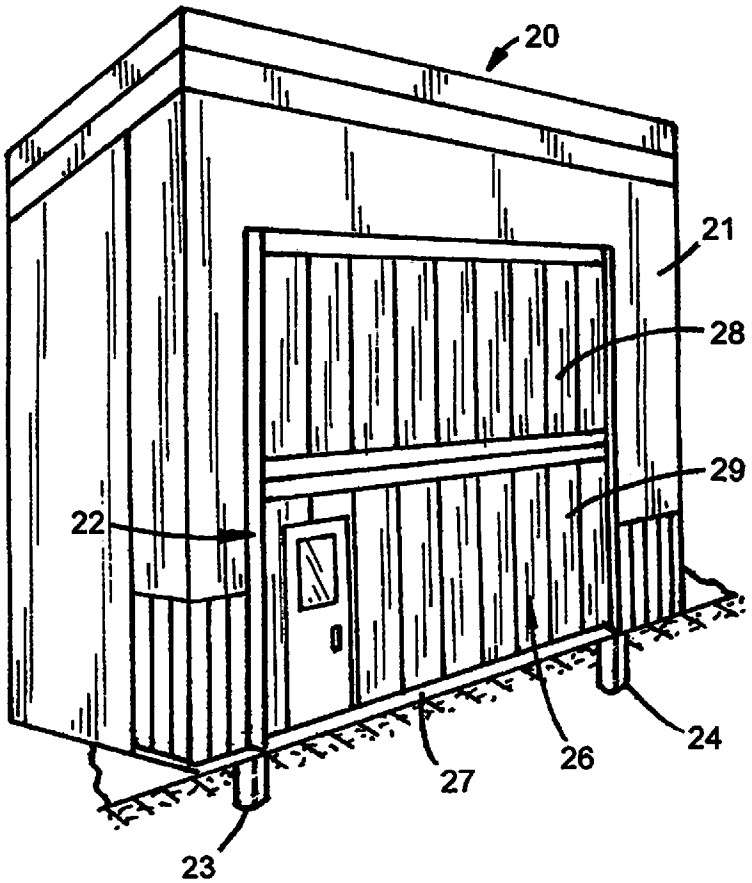
FIG. 1 is a perspective view of a building with an overhead bi-fold door closing a doorway in a side wall of the building.

The following description and drawing of the overhead bi-fold door and door lift apparatus are embodiments in which the invention may be used. Other embodiments of the bi-fold door including structural changes can be made without departing from the invention. As shown in FIG. 1, a building 20 has an upright side wall 21 with an opening or doorway 27 providing access to the interior of the building. A bi-fold door 26, shown as an overhead bi-fold door, is located in an upright position in the doorway to close the doorway. Bi-fold door 26 has upper and lower sections or panels 28 and 29. The upper panel 28 is pivotally connected to a freestanding header 22 located in the doorway 27 for movement between an upright closed position, shown in FIG. 1, and an overhead folded open position shown in FIG. 2 to allow a vehicle 31 to move through doorway 27. Examples of building 20 include automobile garages, aviation hangers, farm shops, commercial and institutional buildings, warehouses and retail structures.

Figure 3:
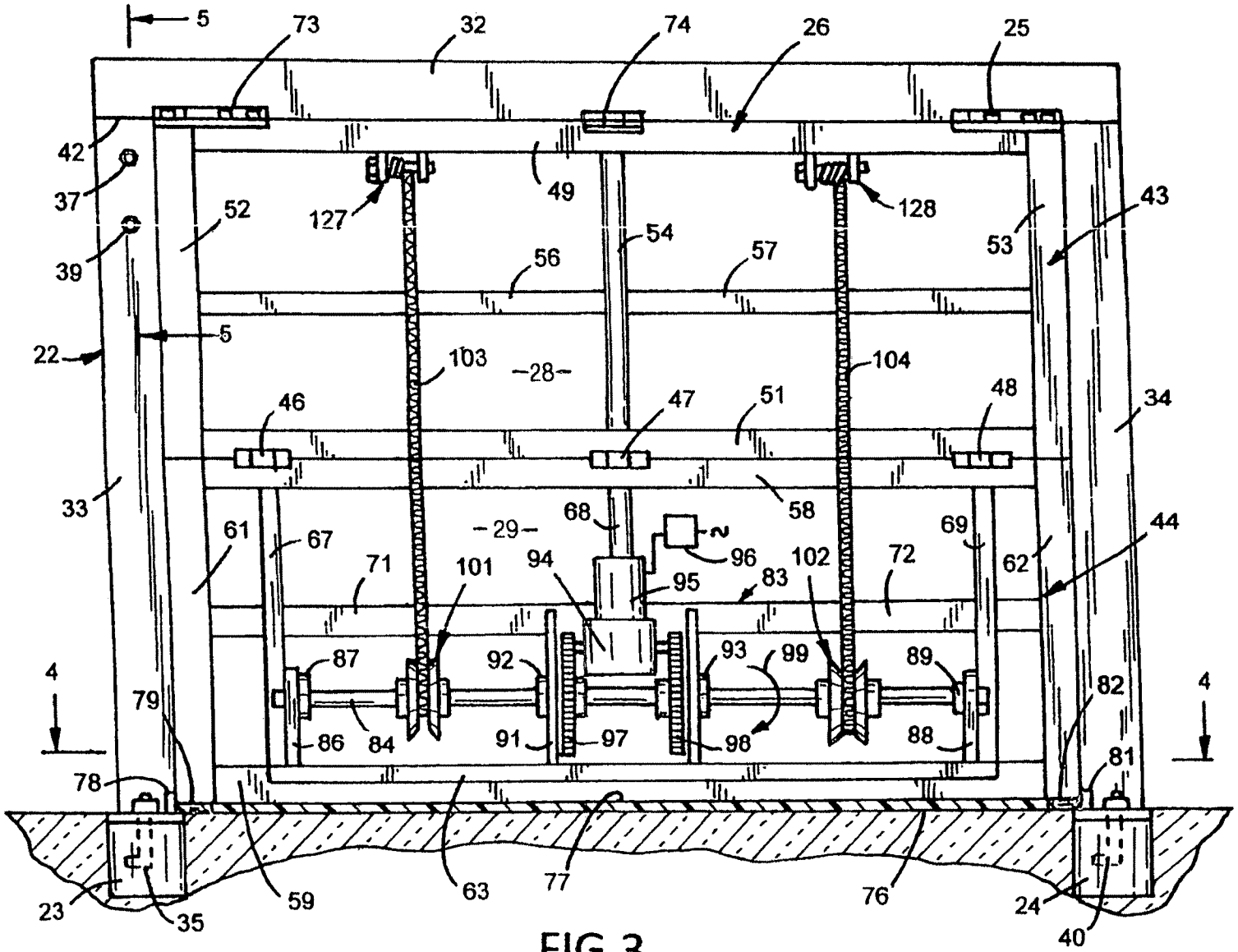
FIG. 3 is an inside elevational view of a first embodiment of the overhead bi-fold door in the closed position connected to a freestanding header.
Figure 4:
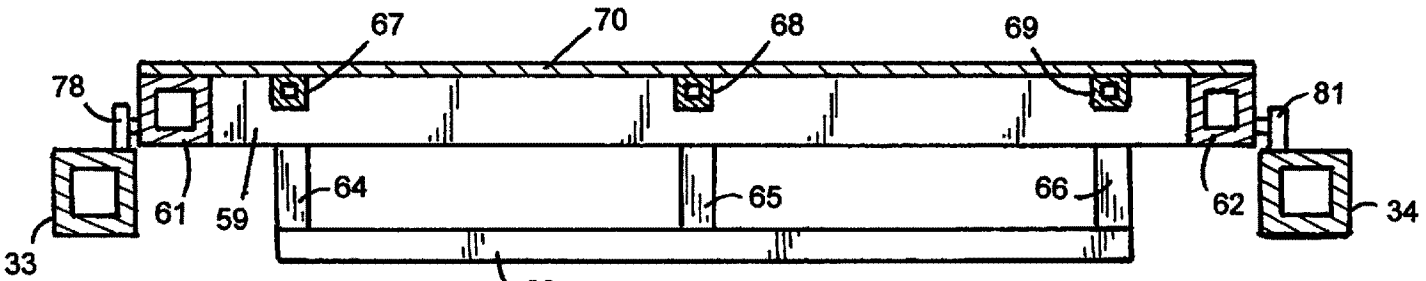
FIG. 4 is a sectional view taken along line 4-4 of FIG. 3.
Figure 5:
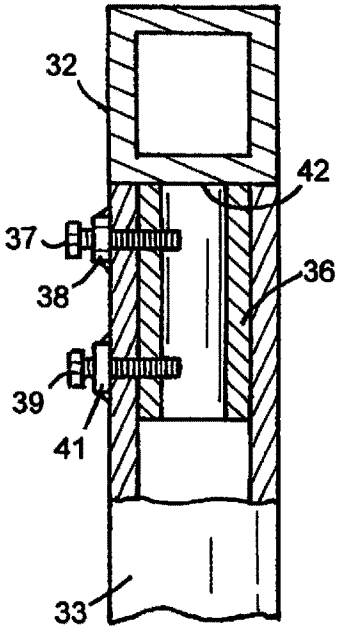
FIG. 5 is an enlarged sectional view taken along line 5-5 of FIG. 3.

The inside or back elevational view of bi-fold door 26, shown in FIG. 3, is in its upright closed position. The freestanding header 22 provides a strong, straight and level structure to attach and support bi-fold door 26. The building frame is not subjected to horizontal loads that the folded or open bi-fold door exerts on header 22. Buildings can be constructed with headers and posts or jambs that have vertical and horizontal strength to support bi-fold door 26. Header 22 comprises a top horizontal header member or beam 32 and upright legs 33 and 34. Header member 32 and legs 33 and 34 are metal tubes. The upper ends of legs 33 and 34 are releasably connected to the opposite ends of header member 32. As shown in FIG. 5, a splice 36 fixed to the bottom 42 of header member 32 telescopes into the open upper end of leg 33. Splice 36 engages the inside wall of leg 33 to maintain leg 33 straight in the vertical plane of header member 32. Fasteners 37 and 39 maintain leg 33 in an attached relationship with header member 32. Fastener 39 is a bolt threaded through a nut 38 secured to leg 33 and extended through aligned holes in leg 33 and splice 36. Fastener 39 is a bolt threaded through a nut 41 secured to leg 33 and extended through aligned holes in leg 33 and splice 36. Other fastening devices can be used to secure splice 36 to leg 33. Leg 34 is attached to header member 32 with a splice having the same structure as splice 36. As shown in FIG. 3, the upper ends of legs 33 and 34 engage the bottom surface 42 of the opposite ends of header member 32 whereby the vertical bi-fold door load on header member 32 is transmitted directly to legs 33 and 34. Legs 33 and 34 can be welded to header member 32. The bottom ends of legs 33 and 34 are connected to anchors 23 and 24 that support freestanding header 22 on floor 77. Anchors 23 and 24 are concrete footings that extend downward into floor 77. Anchor bolts 35 and 40 secure anchors 23 and 24 to legs 33 and 34.

An alternative splice connection for attaching header member 32 to legs 33 and 34 is disclosed by M. L. Schweiss in U.S. Patent Application Publication No. US2016/0362929. The splice structure of this U.S. Patent Publication is incorporated herein by reference.

Bi-fold door 26, shown in FIG. 3, comprises an upper frame 43 and lower frame 44 pivotally connected with hinges 46, 47 and 48. Frame 43 has a top horizontal member 49 and bottom horizontal member 51. Upright end members 52 and 53 are secured with welds to opposite ends of horizontal members 49 and 51. An upright center member 54 is secured to middle portions of top and bottom members 49 and 51. A first horizontal member 56 located between top and bottom members 49 and 51 is secured to end member 52 and center member 54. A second horizontal member 57 located between top member 49 and bottom member 51 is secured to middle portions of end member 53 and center member 54. Members 49 and 51-54, 56 and 57 are tubular metal stock secured together with welds to form a strong, rigid one-piece frame 43. The lower frame 44 has horizontal top and bottom members 58 and 59. Upright end members 61 and 62 are secured to opposite ends of members 58 and 59. The bottom member 59 is reinforced with a horizontal beam 63 joined to bottom member 59 with arms 64, 65 and 66. Beam 63 is located parallel to bottom member 59 to inhibit bending and deflection of bottom member 59. Upright members 67, 68 and 69 located between end members 61 and 62 are secured to top and bottom members 58 and 59. Horizontal middle members 71 and 72 are secured to upright members 67, 68 and 69. Members 58, 59, 61, 62, 67, 68, 69, 71 and 72 and beam 63 are tubular metal stock secured together with welds to form a strong, rigid one-piece frame 44. Hinges 46, 47 and 48 pivotally connect bottom member 51 to top member 58. Hinges 73, 74 and 75 pivotally connect member 49 of upper frame 43 to header member 32 of freestanding header 22. Hinge 46-48 and hinge 73-75 allow bi-fold door 26 to pivot relative to parallel horizontal axes between an upright closed position and a folded open position.

A horizontal flexible seal 76, shown in FIG. 3, is attached to the bottom member 59. Seal 76 extends the length of bottom member 59 and engages the floor or surface 77 below the closed bi-fold door 26. A first roller 78 rotatably connected to a sleeve 79 rides on leg 33 during movement of bi-fold door 26 between its closed and open positions. Sleeve 79 is secured to the bottom of end member 61 of frame 44. A second roller 81 rotatably connected to a sleeve 82 rides on leg 34 during movement of bi-fold door 26 between its closed and open positions. Rollers 78 and 81 engage legs 33 and 34 to prevent twisting of bi-fold door 26 during movement of bi-fold door 26 relative to legs 33 and 34 of freestanding header 22. Rollers 78 and 81 also prevent bi-fold door 26 from swinging outward when in the upright closed position.

Figure 2:
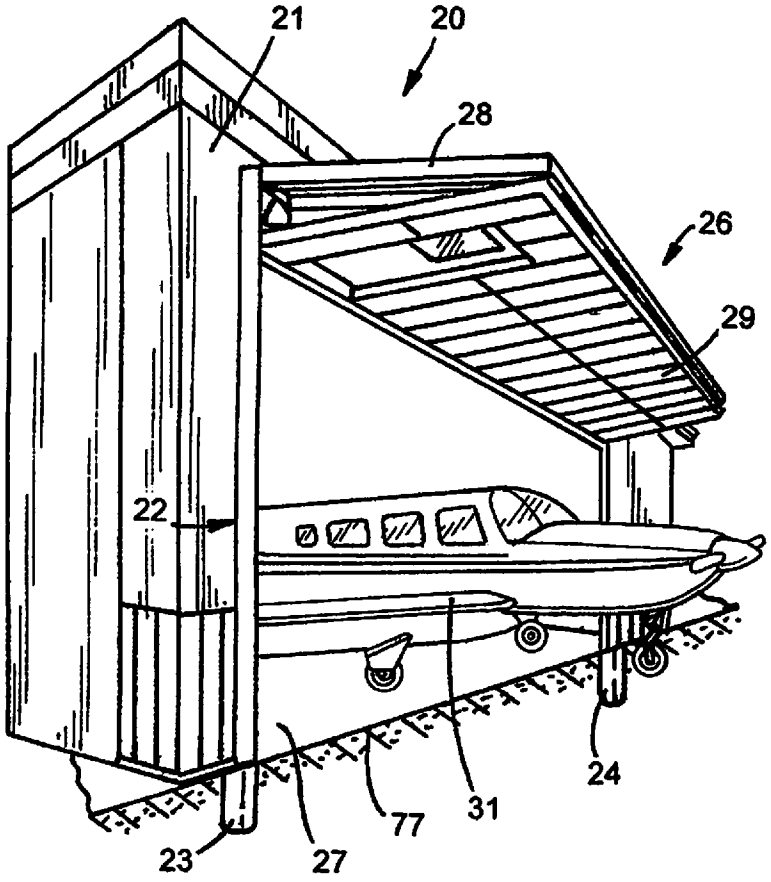
FIG. 2 is a perspective view of the building of FIG. 1 showing the overhead bi-fold door in a folded open position above the doorway of the building.

A door lift device 83 is operable to move bi-fold door 26 from its upright closed position, shown in FIGS. 1 and 3 to its folded open position shown in FIG. 2. Door lift device 83 also holds bi-fold door 26 in the folded open position and allows bi-fold door 26 to move from the folded open position back to the upright closed position. Door lift device 83 comprises a horizontal shaft 84 extended parallel to bottom member 49 of bi-fold door 26. Shaft 84 is rotatably supported on members 67, 59 and beam 63 with a plate 86 and on members 69, 59 and beam 63 with plate 88. A bearing 87 on plate 86 accommodates shaft 84. A bearing 89 on plate 88 accommodates shaft 84. A U-shaped support 91 is secured to upright member 68, bottom member 59 and beam 63. Bearings 92 and 93 attached to the sides of U-shaped support 91 rotatably accommodates shaft 84. A gear box or power transmission 94 mounted on U-shaped support 91 is driven with an electric motor 95. Power transmission 94 includes a brake mechanism that prevents the operation of lift device 83 and holds bi-fold door 26 in the foldable open position. A reversible electric motor 95 is wired to an electric control box 96 that controls the operation of electric motor 95 and brake mechanism associated with the power transmission 94. Power transmission 94 is drivably connected to shaft 84 with a pair of chain and sprocket drives 97 and 98 to rotate shaft 84 shown by arrow 99. Other drive mechanisms such as belts and gears can be used to transmit power from power transmission 94 to shaft 84.

Figure 10:
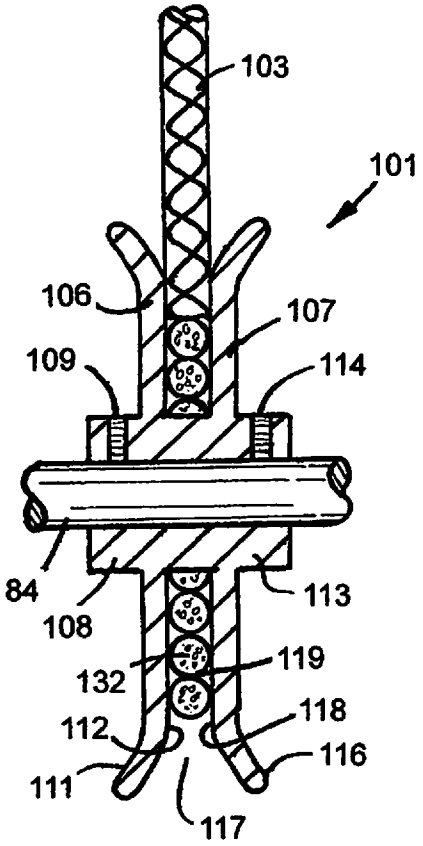
FIG. 10 is a sectional view taken along the line 10-10 of FIG. 9.
Figure 9:
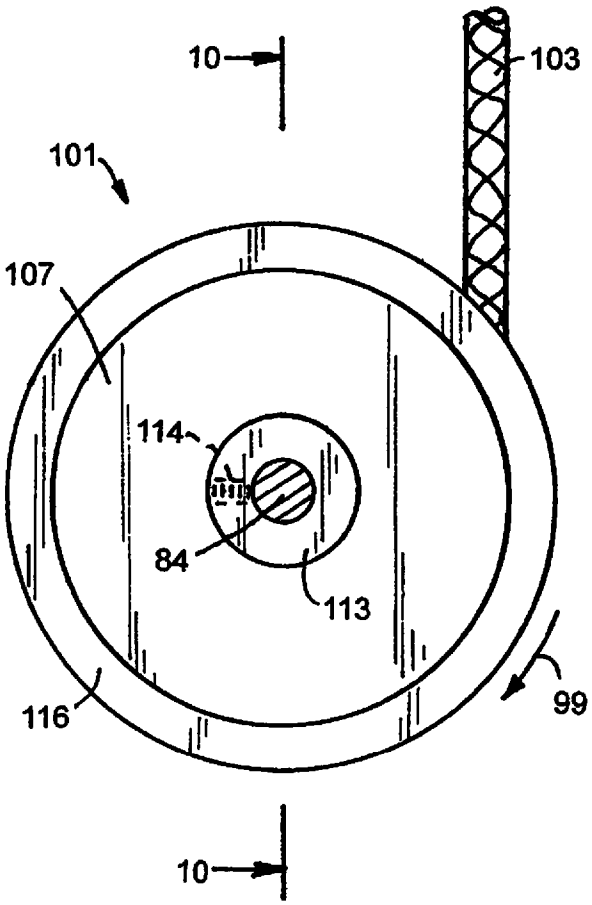
FIG. 9 is a right side elevational view of FIG. 8.
Figure 8:
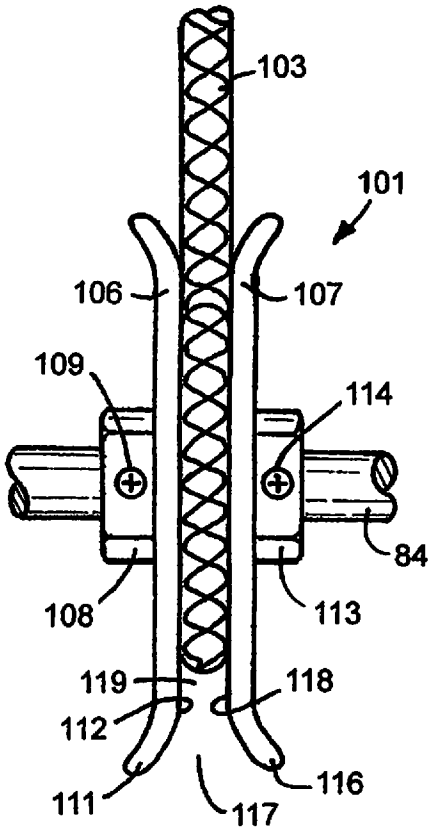
FIG. 8 is an enlarged front elevational view of the overhead bi-fold lift device motion transmitting capstan of FIG. 3.

A pair of capstans 101 and 102 secured to shaft 84 accommodate polymer cylindroids 103 and 104. Capstans 101 and 102 and polymer cylindroids 103 and 104 are identical in structure and function. The following description is directed to capstan 101 and cylindroid 103. Capstan 102 and cylindroid 104 has the same structure and advantages of capstan 101 and cylindroid 103. The number of capstans and associated cylindroids can be increased according to the length, height and weight of the bi-fold door. As shown in FIGS. 8, 9 and 10, capstan 101 has a first circular disk 106 and a second circular disk 107 laterally spaced from first circular disk 106. Disk 106 is joined to a cylindrical hub 108 mounted on shaft 84. A fastener 109, shown as a screw, secures hub 108 to shaft 84 whereby hub 108 and disk 106 rotates with shaft 84. Disk 106 has a peripheral flange or lip 111 extended outwardly at angle of 30 degrees relative to a flat inside wall 112 of disk 106. Second circular disk 107 is joined to a hub 113 accommodating shaft 84. A fastener 114, shown as a screw, secures hub 113 to shaft 84 whereby hub 113 and disk 107 rotate with shaft 84. Other types of fasteners including spline members can be used to secure hubs 108 and 113 to shaft 84. Disk 107 has a peripheral flange or lip 116 extended outwardly at an angle of 30 degrees relative to a flat inside wall 118 of disk 107. The flanges 111 and 116 can have different angles relative to the inside walls 112 and 118 of disks 106 and 107. Flanges 111 and 116 are laterally spaced from each other whereby the space between flanges 111 and 116 is an annular mouth 117 open to a lateral annular chamber 119 between inside walls 112 and 118 of disks 106 and 107. Inside walls 112 and 118 have parallel, circular and flat surfaces whereby annual chamber 119 has a uniform width. Disks 106 and 107 and hubs 108 and 113, as shown in FIG. 10, are a one-piece metal structure. Disks 106 and 107 can be separate parts secured with fasteners to one hub or separate hubs secured to shaft 84.

Figure 12:
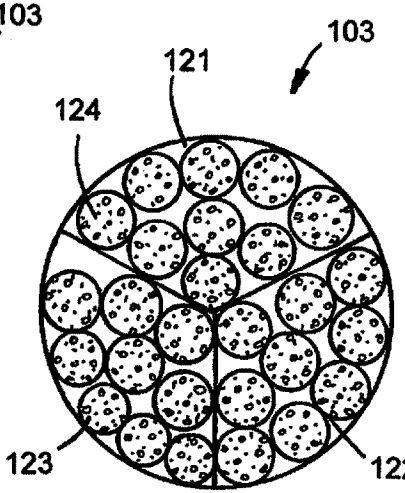
FIG. 12 is a sectional view taken along line 12-12 of FIG. 11.
Figure 11:
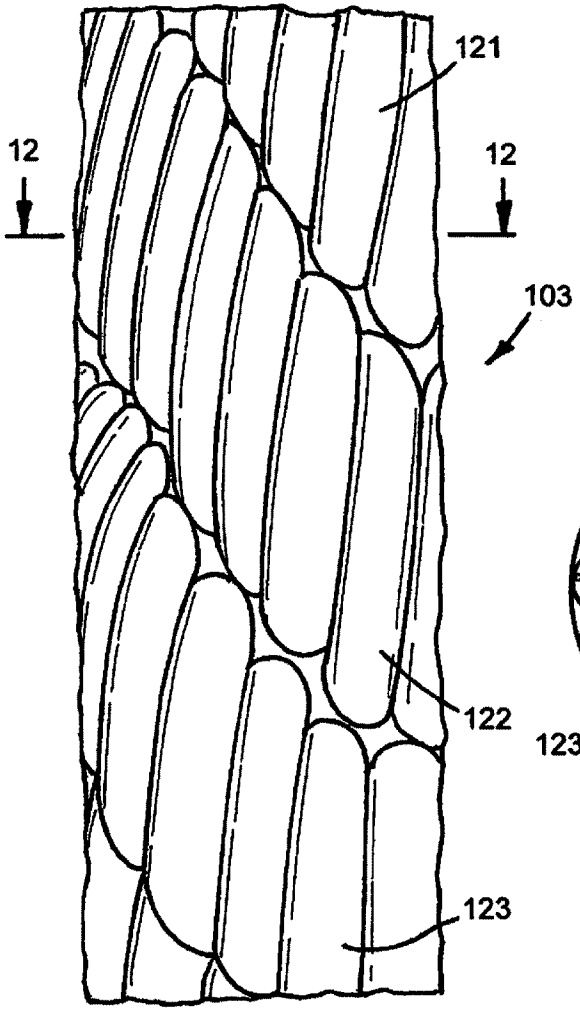
FIG. 11 is an enlarged front elevational view of a portion of the synthetic flexible cylindroid of the overhead bi-fold door lift device of FIG. 3.

Cylindroids 103 and 104 are identical in structure and function. The following description of cylindroid 103 is applicable to cylindroid 104. Cylindroid 103 is an elongated flexible polymer cylindroid lines of synthetic fibers comprising nylon, polyester or polypropylene fibers. Nylon fibers are made from continuous filament polyamide. The fibers are twisted into strands. A plurality of strands are twisted or braided into a cord or line. Cylindroid 103 shown in FIGS. 11 and 12 has three strands 121, 122 and 123. Each strand has a plurality of synthetic fibers 124. The fibers 124 are parallel to the axis 126 of the cylindroid 103 to provide strength and balance and inhibit kinking of cylindroid 103. The cylindroid 103 can have 9, 12 or 18 strands depending on the size of the line. A 12 strand double braided polyester cylindroid has high tension strength, low stretch and good weathering properties. The twist of the synthetic strands serves to keep the cylindroid together and evenly distributes tension forces among the individual strands. The polyester cylindroid is abrasion resistant, UV resistant and does not lose strength when wet. The low stretch properties of a polyester cylindroid is advantageous in the bi-fold device 83. Cylindroids 103 and 104 can have a selected color to match the color of freestanding header 22 or the building wall 21.

Returning to FIG. 3, the upper end of cylindroid 103 is connected to an anchor or tie-down 127 for securing cylindroid 103 to top member 49 of bi-fold door 26. Anchor 127 is operable to adjust the working length of cylindroid 103 between capstan 101 and anchor 127 when the bi-fold door 26 is in the upright closed position. An anchor or tie-down 128 connects the upper end of cylindroid 104 to top member 49 of bi-fold door 26. Anchor 128 has the same structure as anchor 127 and functions to adjust the working length of cylindroid 104 between capstan 102 and anchor 128 when bi-fold door is in the upright closed position. The working lengths of cylindroids 103 and 104 are adjusted to ensure substantially equal tension forces on cylindroids 103 and 104 by lift device 83 during movement of bi-fold door 26 from the closed position to the open position.

Figure 6:
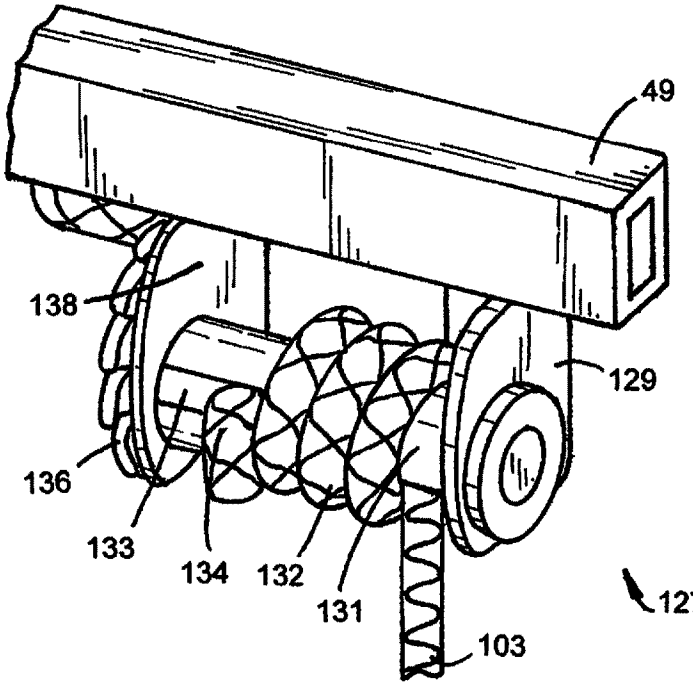
FIG. 6 is an enlarged perspective view of the overhead bi-fold door lift device adjusting anchor mounted on the frame of the bi-fold door.
Figure 7:
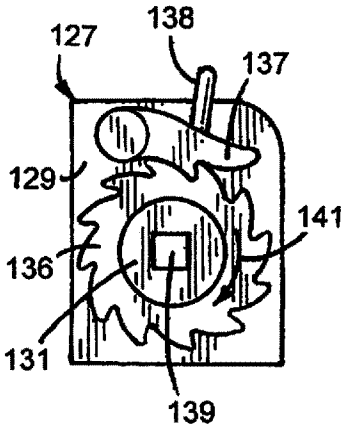
FIG. 7 is a left side elevational view of the adjusting anchor of FIG. 6.

Anchor 127, shown in FIGS. 6 and 7, comprises a U-shaped bracket 129 secured with welds to top member 49 of bi-fold door 26. A tubular sleeve 131 rotatably mounted on bracket accommodates one or more coils 132 of cylindroid 103. Sleeve 131 has a slot or opening 133. An end 134 of cylindroid 103 extends into opening 133 to secure cylindroid 103 to sleeve 131. A ratchet wheel 136 secured to an end of sleeve 131 engages a pawl 137 operable to retain sleeve 131 in a fixed position. Pawl 137 is pivotally mounted on bracket 129. A key 138 extended through a hole in bracket 129 engages pawl 137 to hold pawl 137 in a locked position with ratchet wheel 136 thereby preventing rotation of sleeve 131 relative to bracket 129. Sleeve 131 has a square hole 139 adopted to accommodate a socket wrench or hand tool. Key 138 is removed from bracket 129 to allow the hand tool to be used to rotate sleeve 131, shown by arrow 141, to wind cylindroid 103 on sleeve 131 thereby adjusting the working length and slack of cylindroid 103. Key 138 is returned to the hole in bracket 129 to retain pawl 137 in the locked position on ratchet wheel 136 to maintain the adjusted working length of cylindroid 103. Anchor 128 has the same structure as anchor 127.

Figure 13:
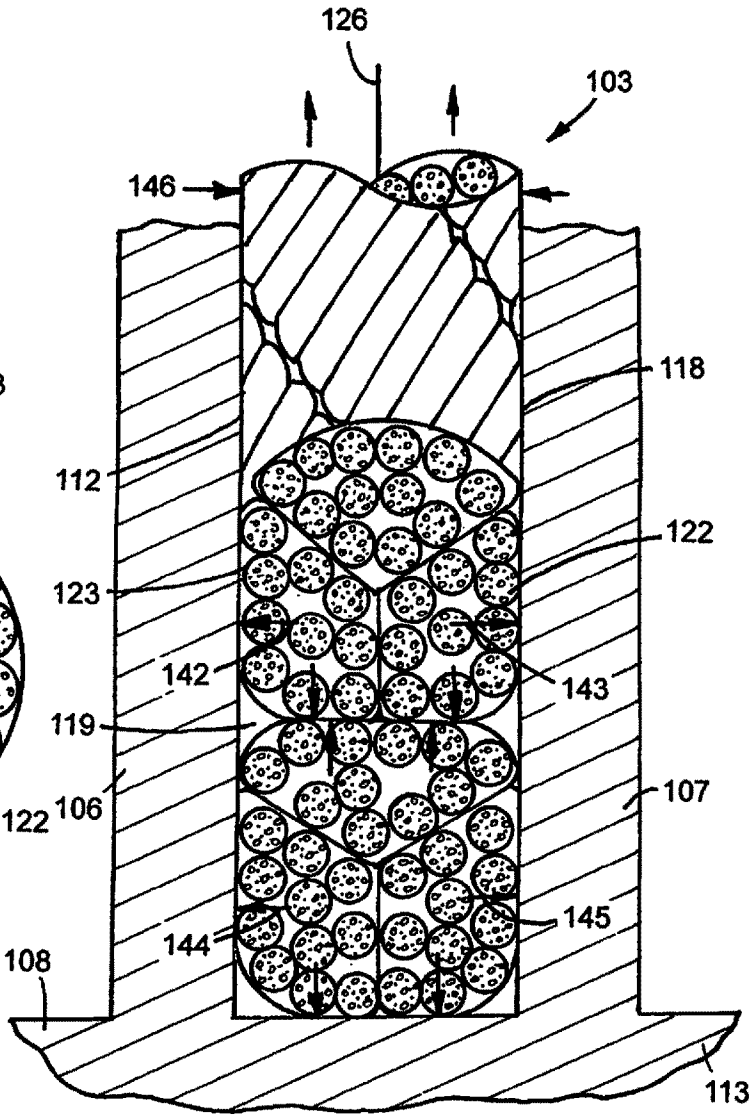
FIG. 13 is an enlarged sectional view of an upper section of FIG. 10.
Figure 18:
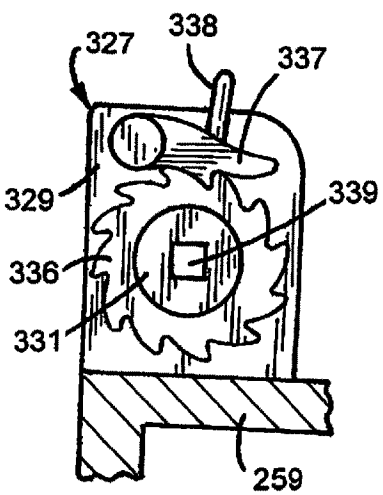
FIG. 18 is a sectional view taken along line 18-18 of FIG. 17.

In use, lift device 83 is activated by operation of electric motor 95 to move bi-fold door 26 from the closed position to the open position. Motor controller 96 is an electric switch that couples electric motor 95 to an electric power supply. Electric motor 95 operates power transmission 94 to rotate shaft 84 shown by arrow 99, via chain and sprocket drives 97 and 98. Capstans 101 and 102 secured to shaft 84 rotates to helically wind cylindroids 103 and 104 between the circular disks 106 and 107. As shown in FIG. 13, cylindroid 103 is compressed against the inside walls 112 and 118, shown by arrows 142 and compressed against the inside walls 112 and 118, shown by arrows 142 and 143, 144 and 145. The tension force on cylindroid is maintained along its center line 126. The tension forces on the fibers 124 and strands 121, 122 and 123 of cylindroid 103 are evenly proportioned or uniform to eliminate stress areas of cylindroid 103. The tension strength of cylindroid 103 is not compromised during the helical winding of cylindroid 103 on capstan 101. The chamber or space 119 between parallel inside walls 112 and 118 of disks 106 and 107 is the diameter 146 of cylindroid 103. The inside walls 112 and 118 prevent cylindroid 103 from wedging or winding side-by-side in the chamber 119 between inside walls 112 and 118. As shown in FIGS. 8 and 18, lips 111 and 116 converge to chamber 119 and function to guide cylindroid 103 into chamber 119. Capstan 102 function to helically accommodate cylindroid 104 in the same manor as capstan 101 accommodates cylindroid 103. The speed or rate of movement of bi-fold door 26 increases as bi-fold door 26 is moved from the upright closed position to the folded open position and slows down as the bi-fold door 26 moves back from the folded open position to the upright closed position.

Bi-fold door 26 is retained in the folded open position adjacent header member 32 by the brake mechanisms of power transmission 94. Bi-fold door 26 is allowed to return from the folded open position back to the upright position, shown in FIG. 3, by reversing the drive of electric motor 95 to release and reverse power transmission 94. Bi-fold door 26 upper and lower frames 43 and 44 pivot relative to each other from folded positions to upright aligned positions. When bi-fold door 26 is in the closed position, seal 76 engages floor 77.

Figure 14:
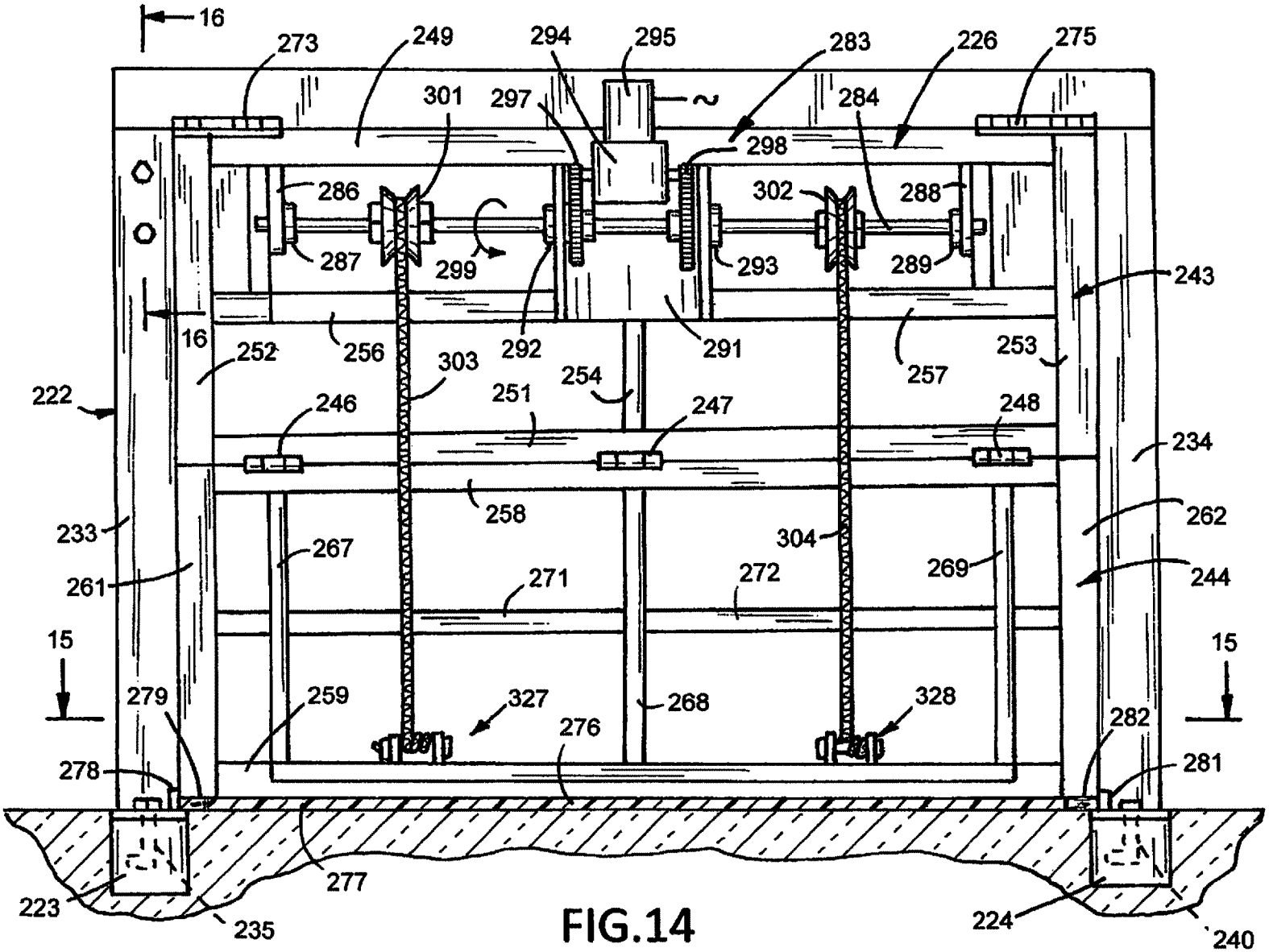
FIG. 14 is an inside elevational view of a second embodiment of the overhead bi-fold door in the closed position connected to a freestanding header.
Figure 16:
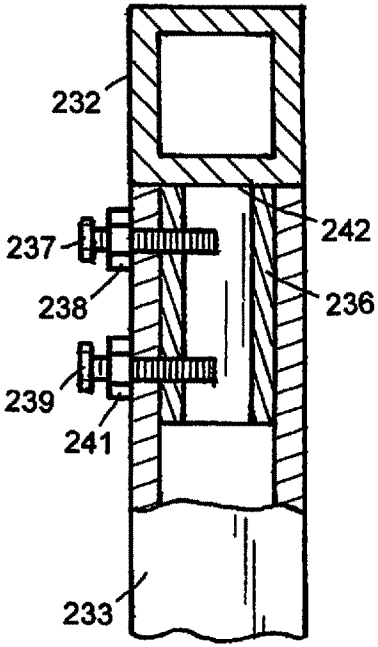
FIG. 16 is an enlarged sectional view taken along line 16-16 of FIG. 14.

The inside or back elevational view of a second embodiment of bi-fold door 226, shown in FIG. 14, is in its upright closed position. A freestanding header 222 provides a strong, straight and level structure to attach and support bi-fold door 226. The building frame is not subjected to horizontal loads that the folded or open bi-fold door exerts on header 222. Buildings can be constructed with headers and posts or jambs that have vertical and horizontal strength to support bi-fold door 226. Header 222 comprises a top horizontal header member or beam 232 and upright legs 233 and 234. Header member 232 and legs 233 and 234 are metal tubes. The upper ends of legs 233 and 234 are releasably connected to the opposite ends of header member 232. As shown in FIG. 16, a splice 236 fixed to the bottom 242 of header member 232 telescopes into the open upper end of leg 233. Splice 236 engages the inside wall of leg 233 to maintain leg 233 straight in the vertical plane of header member 232. Fasteners 237 and 239 maintain leg 233 in an attached relationship with header member 232. Fastener 239 is a bolt threaded through a nut 238 secured to leg 233 and extended through aligned holes in leg 233 and splice 236. Fastener 239 is a bolt threaded through a nut 241 secured to leg 233 and extended through aligned holes in leg 233 and splice 236. Other fastening devices can be used to secure splice 236 to leg 233. Leg 234 is attached to header member 232 with a splice having the same structure as splice 236. As shown in FIG. 14, the upper ends of legs 233 and 234 engage the bottom surface 242 of the opposite ends of header member 232 whereby the vertical bi-fold door load on header member 232 is transmitted directly to legs 233 and 234. Legs 233 and 234 can be welded to header member 232. The bottom ends of legs 233 and 234 are connected to anchors 223 and 224 that support freestanding header 222 on floor 277. Anchors 223 and 224 are concrete footings that extend downward into floor 277. Anchor bolts 235 and 240 secure anchors 223 and 224 to legs 233 and 234.

An alternative splice connection for attaching header member 232 to legs 233 and 234 is disclosed by M. L. Schweiss in U.S. Patent Application Publication No. US2016/0362929. The splice structure of this U.S. patent application publication is incorporated herein by reference.

Figure 15:
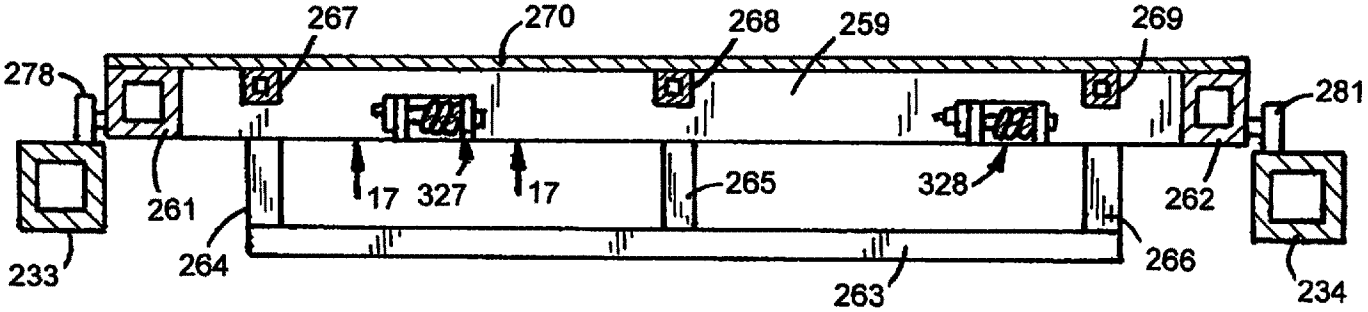
FIG. 15 is a sectional view taken along line 15-15 of FIG. 14.

The second embodiment of bi-fold door 226, shown in FIG. 14, comprises an upper frame 243 and lower frame 244 pivotally connected with hinges 246, 247 and 248. Frame 243 has a top horizontal member 249 and bottom horizontal member 251. Upright end members 252 and 253 are secured with welds to opposite ends of horizontal members 249 and 251. An upright center member 254 is secured to middle portions of top and bottom members 249 and 251. A first horizontal member 256 located between top and bottom members 249 and 251 is secured to end member 252 and center member 254. A second horizontal member 257 located between top member 249 and bottom member 251 is secured to middle portions of end member 253 and center member 254. Members 249 and 251-254, 256 and 257 are tubular metal stock secured together with welds to form a strong, rigid one-piece frame 243. The lower frame 244 has horizontal top and bottom members 258 and 259. Upright end members 261 and 262 are secured to opposite ends of members 258 and 259. As shown in FIG. 15, the bottom member 259 is reinforced with a horizontal beam 263 joined to bottom member 259 with arms 264, 265 and 266. Beam 263 is located parallel to bottom member 259 to inhibit bending and deflection of bottom member 259. Returning to FIG. 14, upright members 267, 268 and 269 located between end members 261 and 262 are secured to top and bottom members 258 and 259. Horizontal middle members 271 and 272 are secured to upright members 267, 268 and 269. Members 258, 259, 261, 262, 267, 268, 269, 271 and 272 and beam 263 are tubular metal stock secured together with welds to form a strong, rigid one-piece frame 244. Hinges 246, 247 and 248 pivotally connect bottom member 251 to top member 258. Hinges 273 and 275 pivotally connect member 249 of upper frame 243 to header member 322 of freestanding header 222. Hinge 246-248 and hinge 273-275 allow bi-fold door 226 to pivot relative to parallel horizontal axes between an upright closed position and a folded open position.

A horizontal flexible seal 276, shown in FIG. 14, is attached to the bottom member 259. Seal 276 extends the length of bottom member 259 and engages the floor or surface 277 below the closed bi-fold door 226. A first roller 278 rotatably connected to a sleeve 279 rides on leg 233 during movement of bi-fold door 226 between its closed and open positions. Sleeve 279 is secured to the bottom of end member 261 of frame 244. A second roller 281 rotatably connected to a sleeve 282 rides on leg 234 during movement of bi-fold door 226 between its closed and open positions. Rollers 278 and 281 engage legs 233 and 234 to prevent twisting of bi-fold door 226 during movement of bi-fold door 226 relative to legs 233 and 234 of freestanding header 222. Rollers 278 and 281 also prevent bi-fold door 226 from swinging outward when in the upright closed position.

A door lift device 283 is operable to move bi-fold door 226 from its upright closed position, shown in FIG. 1, to its folded open position shown in FIG. 2. Door lift device 283 also holds bi-fold door 226 in the folded open position and allows bi-fold door 226 to move from the folded open position back to the upright closed position. Door lift device 283 comprises a horizontal shaft 284 extended parallel to top member 249 of bi-fold door 226. Shaft 284 is rotatably supported on plates 286 and 288 and support 291. A bearing 287 on plate 286 accommodates shaft 284. A bearing 289 on plate 288 accommodates shaft 284. U-shaped support 291 is secured to member 256 and top member 249. Bearings 292 and 293 attached to the sides of U-shaped support 292 rotatably accommodates shaft 284. A gear box or power transmission 294 mounted on U-shaped support 291 is driven with a reversible electric motor 295. Power transmission 294 includes a brake mechanism that prevents the operation of lift device 283 and holds bi-fold door 226 in the closed and foldable open positions. Reversible electric motor 295 is wired to an electric control box that controls the operation of electric motor 295 and brake mechanism associated with the power transmission 294. Power transmission 294 is drivably connected to shaft 284 with a pair of chain and sprocket drives 297 and 298 to rotate shaft 284 shown by arrow 299. Other drive mechanisms such as belts and gears can be used to transmit power from power transmission 294 to shaft 284.

Figure 21:
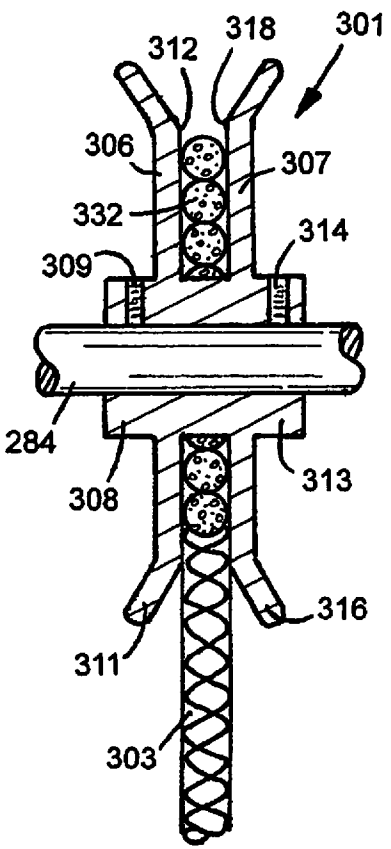
FIG. 21 is a sectional view taken along line 21-21 of FIG. 20.
Figure 20:
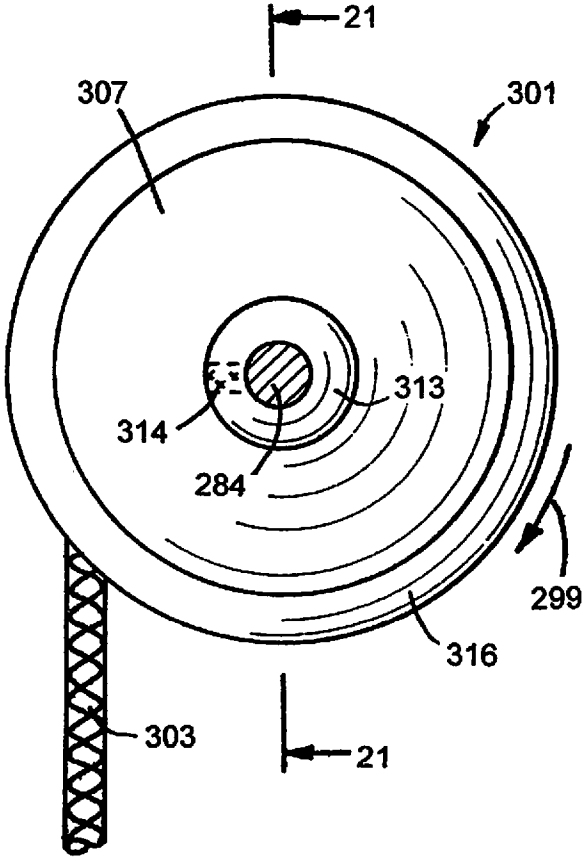
FIG. 20 is a right side elevational view of FIG. 19.
Figure 19:
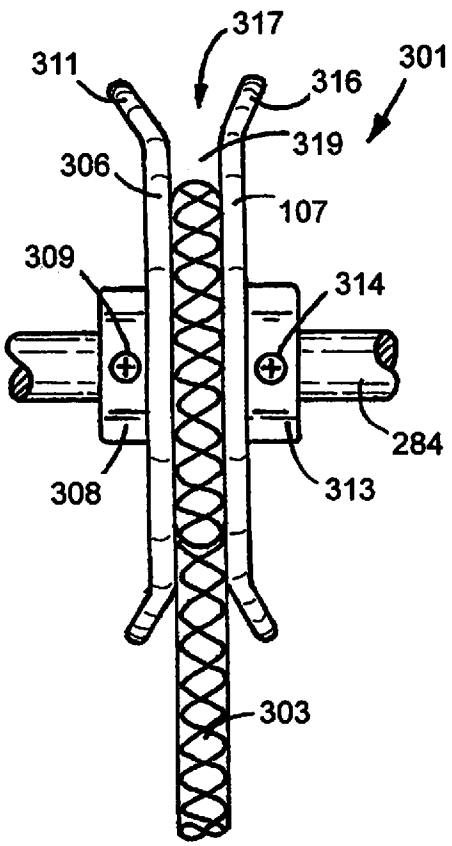
FIG. 19 is an enlarged front elevational view of the overhead bi-fold door lift device motion transmitting capstan of FIG. 14.

A pair of capstans 301 and 302 secured to shaft 284 accommodate polymer cylindroids 303 and 304. Capstans 301 and 302 and polymer cylindroids 303 and 304 are identical in structure and function. The following description is directed to capstan 301 and cylindroid 303. Capstan 302 and cylindroid 304 has the same structure and advantages of capstan 301 and cylindroid 303. The number of capstans and associated cylindroids can be increased according to the length, height and weight of the bi-fold door. As shown in FIGS. 19, 20 and 21, capstan 301 has a first circular disk 306 and a second circular disk 307 laterally spaced from first circular disk 306. Disk 306 is joined to a cylindrical hub 308 mounted on shaft 284. A fastener 309, shown as a screw, secures hub 308 to shaft 284 whereby hub 308 and disk 306 rotates with shaft 284. Disk 306 has a peripheral flange or lip 311 extended outwardly at angle of 30 degrees relative to a flat inside wall 312 of disk 306. Second circular disk 307 is joined to a hub 313 accommodating shaft 284. A fastener 314, shown as a screw, secures hub 313 to shaft 284 whereby hub 313 and disk 307 rotate with shaft 284. Other types of fasteners including spline members can be used to secure hubs 308 and 313 to shaft 284. Disk 307 has a peripheral flange or lip 316 extended outwardly at an angle of 30 degrees relative to a flat inside wall 318 of disk 307. The flanges 311 and 316 can have different angles relative to the inside walls 312 and 318 of disks 306 and 307. Flanges 311 and 316 are laterally spaced from each other whereby the space between flanges 311 and 316 is an annular mouth 317 open to a lateral annular chamber 319 between inside walls 312 and 318 of disks 306 and 307. Inside walls 312 and 318 have parallel, circular and flat surfaces whereby annual chamber 319 has a uniform width. Disks 306 and 307 and hubs 308 and 313, as shown in FIG. 10, are a one-piece metal structure. Disks 306 and 307 can be separate parts secured with fasteners to one hub or separate hubs secured to shaft 284.

Figure 23:
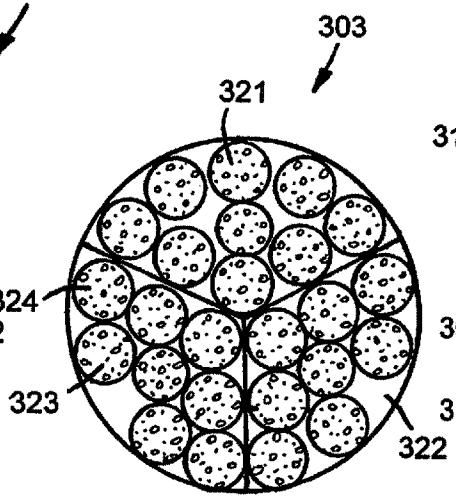
FIG. 23 is a sectional view taken along line 23-23 of FIG. 22.
Figure 22:
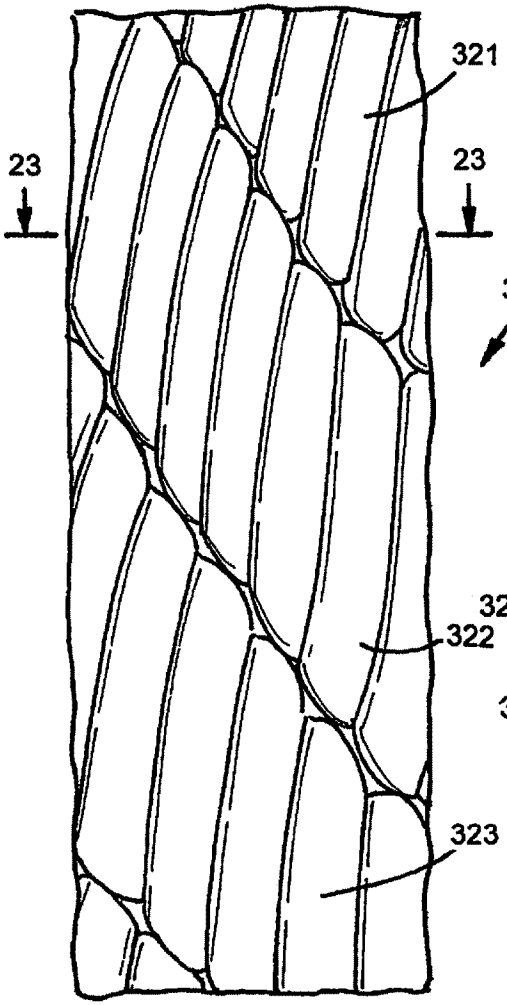
FIG. 22 is an enlarged front elevational view of a portion of the synthetic flexible cylindroid of the overhead bi-fold lift device of FIG. 14.

Cylindroids 303 and 304 are identical in structure and function. The following description of cylindroid 303 is applicable to cylindroid 304. Cylindroid 303 is an elongated flexible polymer cylindroid lines of synthetic fibers comprising nylon, polyester or polypropylene fibers. Nylon fibers are made from continuous filament polyamide. The fibers are twisted into strands. A plurality of strands are twisted or braided into a cord or line. Cylindroid 303 shown in FIGS. 22 and 23 has three strands 321, 322 and 323. Each strand has a plurality of synthetic fibers 324. The fibers 324 are parallel to the axis 326 of the cylindroid 303 to provide strength and balance and inhibit kinking of cylindroid 303. The cylindroid 303 can have 9, 12 or 18 strands depending on the size of the line. A 12 strand double braided polyester cylindroid has high tension strength, low stretch and good weathering properties. The twist of the synthetic strands serves to keep the cylindroid together and evenly distributes tension forces among the individual strands. The polyester cylindroid is abrasion resistant, UV resistant and does not lose strength when wet. The low stretch properties of a polyester cylindroid is advantageous in the bi-fold device 283. Cylindroids 303 and 304 can have a selected color to match the color of freestanding header 222 or building wall 221.

Returning to FIG. 14, the upper end of cylindroid 303 is connected to an anchor or tie-down 327 for securing cylindroid 303 to top member 249 of bi-fold door 226. Anchor 327 is operable to adjust the working length of cylindroid 303 between capstan 301 and anchor 327 when the bi-fold door 226 is in the upright closed position. An anchor or tie-down 328 connects the lower end of cylindroid 304 to bottom member 249 of bi-fold door 226. Anchor 328 has the same structure as anchor 327 and functions to adjust the working length of cylindroid 304 between capstan 302 and anchor 328 when bi-fold door is in the upright closed position. The working lengths of cylindroids 303 and 304 are adjusted to ensure substantially equal tension forces on cylindroids 303 and 304 by lift device 283 during movement of bi-fold door 226 from the closed position to the open position.

Figure 17:
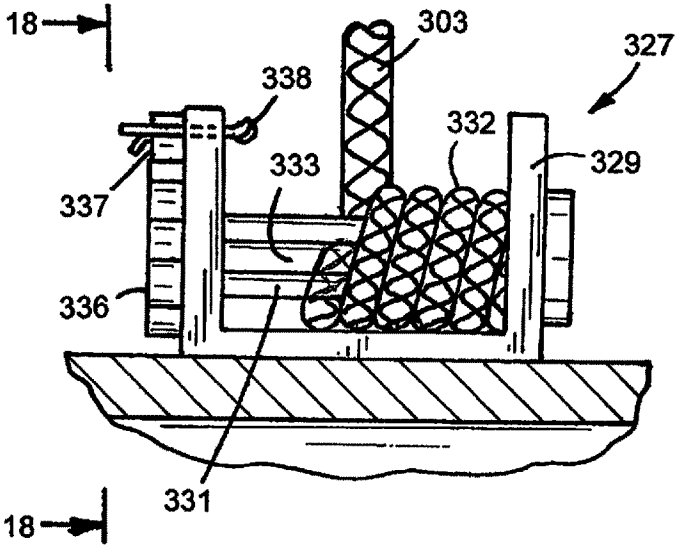
FIG. 17 is an enlarged sectional view taken along line 17-17 of FIG. 15.

Anchor 327, shown in FIGS. 17 and 18, comprises a U-shaped bracket 329 secured with welds to member 249 of bi-fold door 226. A tubular sleeve 331 rotatably mounted on bracket 339 accommodates one or more coils 332 of cylindroid 303. Sleeve 331 has a slot or opening 333. An end of cylindroid 303 extends into opening 333 to secure cylindroid 303 to sleeve 331. A ratchet wheel 136 secured to an end of sleeve 331 engages a pawl 337 operable to retain sleeve 331 in a fixed position. Pawl 337 is pivotally mounted on bracket 329. A key 338 extended through a hole in bracket 329 engages pawl 337 to hold pawl 337 in a locked position with ratchet wheel 336 thereby preventing rotation of sleeve 331 relative to bracket 329. Sleeve 331 has a square hole 339 adopted to accommodate a socket wrench or hand tool. Key 338 is removed from bracket 329 to allow the hand tool to be used to rotate sleeve 331 to wind cylindroid 303 on sleeve 331 thereby adjusting the working length and slack of cylindroid 303. Key 338 is returned to the hole in bracket 329 to retain pawl 337 in the locked position on ratchet wheel 336 to maintain the adjusted working length of cylindroid 303. Anchor 328 has the same structure as anchor 327.

Figure 24:
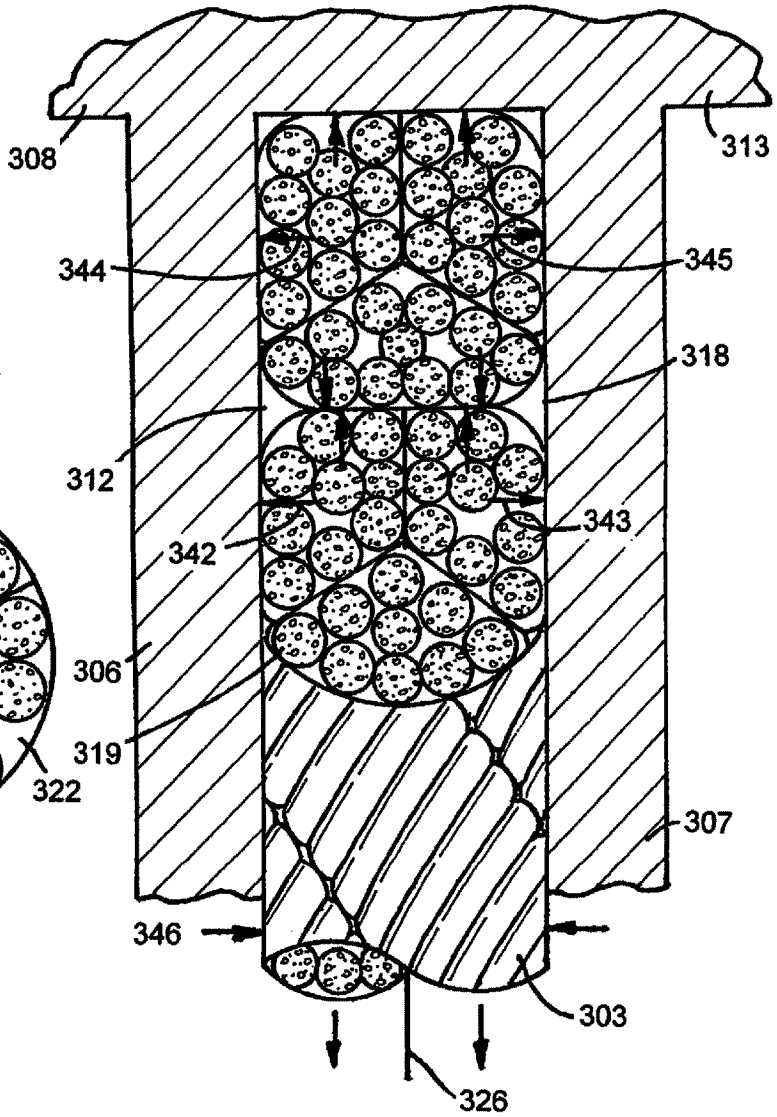
FIG. 24 is an enlarged sectional view of a lower section of FIG. 21.

In use, lift device 283 is activated by operation of electric motor 295 to move bi-fold door 226 from the closed position to the open position. Electric motor 295 operates power transmission 294 to rotate shaft 284 shown by arrow 299, via chain and sprocket drives 297 and 298. Capstans 301 and 302 secured to shaft 284 rotates to helically wind cylindroids 303 and 304 between the circular disks 306 and 307. As shown in FIG. 24, cylindroid 303 is compressed against the inside walls 312 and 318, shown by arrows 342 and compressed against the inside walls 312 and 318, shown by arrows 342 and 343, 344 and 345. The tension force on cylindroid is maintained along its center line 326. The tension forces on the fibers 324 and strands 321, 322 and 323 of cylindroid 303 are evenly proportioned or uniform to eliminate stress areas of cylindroid 303. The tension strength of cylindroid 303 is not compromised during the helical winding of cylindroid 303 on capstan 301. The chamber or space 319 between parallel inside walls 312 and 318 of disks 306 and 307 is the diameter 346 of cylindroid 303. The inside walls 312 and 318 prevent cylindroid 303 from wedging or winding side-by-side in the chamber 319 between inside walls 317 and 318. As shown in FIGS. 19 and 29, lips 311 and 316 converge to chamber 319 and function to guide cylindroid 303 into chamber 319. Capstan 302 function to helically accommodate cylindroid 304 in the same manor as capstan 301 accommodates cylindroid 303. The speed or rate of movement of bi-fold door 226 increases as bi-fold door 226 is moved from the upright closed position to the folded open position and slows down as the bi-fold door 226 moves back from the folded open position to the upright closed position.

Bi-fold door 226 is retained in the folded open position adjacent header member 232 by the brake mechanisms of power transmission 294. Bi-fold door 226 is allowed to return from the folded open position back to the upright position, shown in FIG. 14, by reversing the drive of electric motor 295 to release and reverse power transmission 294. Bi-fold door 226 upper and lower frames 243 and 244 pivot relative to each other from folded positions to upright aligned positions. When bi-fold door 226 is in the closed position, seal 276 engages floor 277.

The overhead bi-fold door has been described and illustrated in the drawing in connection with several embodiments thereof. Changes in materials, structures and arrangement of structures may be made by persons skilled in the art without departing from the scope of the invention.

The invention claimed is:

1. An overhead bi-fold door for selectively opening and closing a doorway of a structure comprising:

a first panel having a first frame including an upper horizontal frame member and a lower horizontal frame member, a plurality of first hinges for pivotally connecting the upper horizontal frame member of the first panel to the structure, a second panel having a second frame including an upper horizontal frame member and a lower horizontal frame member, a plurality of second hinges connecting the lower horizontal frame member of the first panel to the upper horizontal frame member of the second panel, said first and second hinges being operable to allow the first panel and the second panel to be moved from aligned upright positions, closing the doorway to side-by-side folded positions opening the doorway, sheathing attached to the first and second frames of the first panel and the second panel, a door lift device operable to selectively move the first panel and the second panel from the aligned upright positions to the side-by-side folded positions and allow the first and second panels to move from the side-by-side folded positions back to the aligned upright positions to close the doorway comprising:

a horizontal shaft located adjacent the lower horizontal frame member of the second panel, supports secured to the second panel rotatably holding the horizontal shaft on the second panel, a power transmission drivably connected to the shaft for rotating the shaft, a bracket securing the power transmission to the second panel, a reversible electric motor drivably connected to the power transmission for operating the power transmission to selectively rotate the shaft in opposite directions, a plurality of capstans secured to the shaft for rotation with the shaft, each capstan including:

a hub secured to the shaft, a first disk joined to the hub, a second disk joined to the hub, said first disk having a first circular flat wall, extended radially away from the shaft, said second disk having a second flat circular wall laterally spaced from the first flat circular wall of the first disk, said first and second flat circular walls being parallel to each other, a flexible cylindroid having cooperating strands of polymer fibers, the cylindroid having a first end section located between and in contact with the first and second flat walls of the first and second disks and a second end section, anchors secured to the upper horizontal frame member of the first panel, said capstan upon rotation of the shaft by the power transmission in one direction helically winds the first section of the cylindroid around the hub in the space between the first and second disks to move the first panel and the second panel of the bi-fold door at an increasing rate of speed from the upright aligned closed positions to the folded open positions and upon rotation of the shaft in a direction opposite the one direction, the first section of the cylindroid unwinds from between the first and second disks to allow the first panel and the second panel to move at a decreasing rate of speed from the folded open positions back to the upright aligned closed positions, each anchor including a bracket secured to the upper horizontal frame member of the first panel, a sleeve rotatably mounted on the bracket, said second end section of the cylindroid being connected to and wrapped around the sleeve to adjust the length of the cylindroid between the capstan and anchor, a ratchet wheel connected to the sleeve, and a latch engageable with the ratchet wheel to prevent rotation of the ratchet wheel and sleeve thereby maintaining the adjusted length of the cylindroid between the capstan and anchor, said latch disengaged from the ratchet wheel to allow the ratchet wheel and sleeve to be rotated to adjust the length of the cylindroid between the capstan and anchor.

2. The overhead bi-fold door of claim 1 wherein:

the first disk of the capstan includes an annular peripheral lip extended outwardly from the flat wall of the first disk, the second disk of the capstan includes an annular peripheral lip extended outwardly from the flat wall of the second disks, the lips of the first and second disks are laterally spaced from each other and guide the cylindroid into the space between the flat walls of the first and second disks during the winding of the cylindroid on the capstan.

3. The overhead bi-fold door of claim 1 wherein:

the polymer fibers of the strands of the cylindroid comprises polyester fibers.

4. The overhead bi-fold door of claim 1 wherein:

the polymer fibers of the strands of the cylindroid comprise nylon fibers.

5. A combination of a freestanding header and an overhead bi-fold door for opening and closing a passage in a structure comprising:

a freestanding header located around the passage in the structure, a freestanding header includes a horizontal header member having a first end and a second end, a first upright leg engageable with the first end of the horizontal header member, a first splice secured to the first end of the horizontal header member and engageable with the first leg, first fasteners securing the first leg to the first splice to retain the first leg in engagement with the first end of the horizontal header member, a second upright leg engageable with the second end of the horizontal header member, a second splice secured to the second end of the horizontal header member and engageable with the second end of the horizontal member, second fasteners securing the second leg to the second splice to retain the second leg in engagement with the second end of the horizontal header member, an overhead bi-fold door for selectively opening and closing the passage in the structure comprising a first panel having a first frame including an upper horizontal frame member and a lower horizontal frame member, a plurality of first hinges pivotally connecting the upper horizontal frame member of the first panel to the horizontal header, a second panel having a second frame including an upper horizontal frame member and a lower horizontal frame member, a plurality of second hinges connecting the lower horizontal frame member of the first panel to the upper horizontal frame member of the second panel, said first and second hinges being operable to allow the first and second panels to be moved from aligned upright positions, closing the passage to side-by-side folded positions opening the passage, sheathing attached to the first and second frames of the first panel and the second panel, a door lift device operable to selectively move the first panel and the second panel from the aligned upright positions to the side-by-side folded positions and allow the first panel and the second panel to move from the side-by-side folded positions back to the aligned upright positions to close the passage comprising:

a horizontal shaft located adjacent the lower horizontal frame member of the second panel, supports secured to the second frame of the second panel rotatably holding the horizontal shaft on the second panel, a power transmission drivably connected to the shaft for rotating the shaft, a bracket securing the power transmission to the second frame of the second panel, a reversible electric motor drivably connected to the power transmission for operating the power transmission to selectively rotate the shaft in opposite directions, a plurality of capstans secured to the shaft for rotation with the shaft, each capstan including:

a hub secured to the shaft, a first disk joined to the hub, a second disk joined to the hub, said first disk having a first circular flat wall, extended radially away from the shaft, said second disk having a second flat circular wall laterally spaced from the first flat circular wall of the first disk, said first and second flat circular walls being parallel to each other, a flexible cylindroid having cooperating strands of polymer fibers, the cylindroid having a first end section located between and in contact with the first and second flat walls of the first and second disks and a second end section, anchors secured to the upper horizontal frame member of the first panel, said capstan upon rotation of the shaft by the power transmission in one direction helically winds the first section of the cylindroid around the hub in the space between the first and second disks to move the first and second panels of the bi-fold door at an increasing rate of speed from the upright aligned closed positions to the folded open positions and upon rotation of the shaft in a direction opposite the one direction, the first section of the cylindroid unwinds from between the first and second disks to allow the first panel and the second panel to move at a decreasing rate of speed from the folded open positions back to the upright aligned closed positions, each anchor including a bracket secured to the upper horizontal frame member of the first panel, a sleeve rotatably mounted on the bracket, said second end section of the cylindroid being connected to and wrapped around the sleeve to adjust the length of the cylindroid between the capstan and anchor, a ratchet wheel connected to the sleeve, and a latch engageable with the ratchet wheel to prevent rotation of the ratchet wheel and sleeve thereby maintaining the adjusted length of the cylindroid between the capstan and anchor, said latch being disengaged from the ratchet wheel to allow the ratchet wheel and sleeve to be rotated to adjust the length of the cylindroid between the capstan and anchor.

6. The combination of claim 5 wherein:

the first disk of the capstan includes an annular peripheral lip extended outwardly from the flat wall of the first disk, the second disk of the capstan includes an annular peripheral lip extended outwardly from the flat wall of the second disks, the lips of the first and second disks are laterally spaced from each other and guide the cylindroid into the space between the flat walls of the first and second disks during the winding of the cylindroid on the capstan.

7. The combination of claim 5 wherein:

the polymer fibers of the strands of the cylindroid comprises polyester fibers.

8. The combination of claim 5 wherein:

the polymer fibers of the strands of the cylindroid comprise nylon fibers.

9. An overhead bi-fold door for selectively opening and closing a doorway of a structure comprising:

a first panel having a first frame including an upper horizontal frame member and a lower horizontal frame member, a plurality of first hinges for pivotally connecting the upper horizontal frame member of the first frame of the first panel to the structure, a second panel having a second frame including an upper horizontal frame member and a lower horizontal frame member, a plurality of second hinges connecting the lower horizontal frame member of the first panel to the upper horizontal frame member of the second panel, said first and second hinges being operable to allow the first panel and the second panel to be moved from aligned upright positions, closing the doorway to side-by-side folded positions opening the doorway, sheathing attached to the first and second frames of the first and second panels, a door lift device operable to selectively move the first panel and the second panel from the aligned upright positions to the side-by-side folded positions and allow the first panel and the second panel to move from the side-by-side folded positions back to the aligned upright positions to close the doorway comprising:

a horizontal shaft located adjacent the upper horizontal frame member of the first panel, supports secured to the first frame of the first panel, bearings mounted on the supports rotatably supporting the shaft, a power transmission drivably connected to the shaft to rotate the shaft, a bracket securing the power transmission to the first frame of the first panel, a reversible electric motor for operating the power transmission to selectively rotate the shaft in opposite directions, a plurality of capstans secured to the shaft for rotation with the shaft, each capstan including:

a hub secured to the shaft, a first disk joined to the hub, a second disk joined to the hub, said first disk having a first circular flat wall, extended radially away from the shaft, said second disk having a second flat circular wall laterally spaced from the first flat circular wall of the first disk, said first and second flat circular walls being parallel to each other, a flexible cylindroid having cooperating strands of polymer fibers, the cylindroid having a first end section located between and in contact with the first and second flat walls of the first disk and the second disk and a second end section, anchors secured to the lower horizontal frame member of the second panel, said capstan upon rotation of the shaft by the power transmission in one direction helically winds the first section of the cylindroid around the hub in the space between the first and second disks to move the first and second panels of the bi-fold door at an increasing rate of speed from the upright aligned closed positions to the folded open positions and upon rotation of the shaft in a direction opposite the one direction, the first section of the cylindroid unwinds from between the first and second disks to allow the first and second panels to move at a decreasing rate of speed from the folded open positions back to the upright aligned closed positions, each anchor including a bracket secured to the lower horizontal frame member of the second panel, a sleeve rotatably mounted on the bracket, said second end section of the cylindroid being connected to and wrapped around the sleeve to adjust the length of the cylindroid between the capstan and anchor, a ratchet wheel connected to the sleeve, and a latch engageable with the ratchet wheel to prevent rotation of the ratchet wheel and sleeve thereby maintaining the adjusted length of the cylindroid between the capstan and anchor, said latch being disengaged from the ratchet wheel to allow the ratchet wheel and sleeve to be rotated to adjust the length of the cylindroid between the capstan and anchor.

10. The overhead bi-fold door of claim 9 wherein:

the first disk of the capstan includes an annular peripheral lip extended outwardly from the flat wall of the first disk, the second disk of the capstan includes an annular peripheral lip extended outwardly from the flat wall of the second disks, the lips of the first and second disks are laterally spaced from each other and guide the cylindroid into the space between the flat walls of the first and second disks during the winding of the cylindroid on the capstan.

11. The overhead bi-fold door of claim 9 wherein:

the polymer fibers of the strands of the cylindroid comprises polyester fibers.

12. The overhead bi-fold door of claim 9 wherein:

the polymer fibers of the strands of the cylindroid comprise nylon fibers.

13. A combination of a freestanding header and an overhead bi-fold door for opening and closing a passage in a structure comprising:

a freestanding header located around the passage in the structure, a freestanding header includes a horizontal header member having a first end and a second end, a first upright leg engageable with the first end of the horizontal header member, a first splice secured to the first end of the horizontal header member and engageable with the first leg, first fasteners securing the first leg to the first splice to retain the first leg in engagement with the first end of the horizontal header member, a second upright leg engageable with the second end of the horizontal header member, a second splice secured to the second end of the horizontal header member and engageable with the second end of the horizontal member, second fasteners securing the second leg to the second splice to retain the second leg in engagement with the second end of the horizontal header member, an overhead bi-fold door for selectively opening and closing the passage in the structure comprising a first panel having a first frame including an upper horizontal frame member and a lower horizontal frame member, a plurality of first hinges pivotally connecting the upper horizontal frame member of the first panel to the horizontal header, a second panel having a second frame including an upper horizontal frame member and a lower horizontal frame member, a plurality of second hinges connecting the lower horizontal frame member of the first panel to the upper horizontal frame member of the second panel, said first and second hinges being operable to allow the first panel and the second panel to be moved from aligned upright positions, closing the passage to side-by-side folded positions opening the passage, a door lift device operable to selectively move the first panel and the second panel from the aligned upright positions to the side-by-side folded positions and allow the first panel and the second panel to move from the side-by-side folded positions back to the aligned upright positions to close the passage comprising:

a horizontal shaft located adjacent the lower horizontal frame member of the second panel, supports secured to the second frame of the second panel for rotatably supporting the shaft, a power transmission mounted on the second frame of the second panel and drivably connected to the shaft operable to rotate the shaft, a reversible electric motor for operating the power transmission to selectively rotate the shaft in opposite directions, a plurality of capstans secured to the shaft for rotation with the shaft, each capstan including:

a hub secured to the shaft, a first disk joined to the hub, a second disk joined to the hub, said first disk having a first circular flat wall, extended radially away from the shaft, said second disk having a second flat circular wall laterally spaced from the first flat circular wall of the first disk, said first and second flat circular walls being parallel to each other, a flexible cylindroid having a first end section located between and in contact with the first and second flat walls of the first disk and the second disk and a second end section, anchors secured to the upper horizontal frame member of the first panel, said capstan upon rotation of the shaft by the power transmission in one direction helically winds the first section of the cylindroid around the hub in the space between the first and second disks to move the first panel and the second panel of the bi-fold door at an increasing rate of speed from the upright aligned closed positions to the folded open positions and upon rotation of the shaft in a direction opposite the one direction, the first section of the cylindroid unwinds from between the first and second disks to allow the first panel and the second panel to move at a decreasing rate of speed from the folded open positions back to the upright aligned closed positions, each anchor including a bracket secured to the lower horizontal frame member of the second panel, a sleeve rotatably mounted on the bracket, said second end section of the cylindroid being connected to and wrapped around the sleeve to adjust the length of the cylindroid between the capstan and anchor, a ratchet wheel connected to the sleeve, and a latch engageable with the ratchet wheel to prevent rotation of the ratchet wheel and sleeve thereby maintaining the adjusted length of the cylindroid between the capstan and anchor, said latch being disengaged from the ratchet wheel to allow the ratchet wheel and sleeve to be rotated to adjust the length of the cylindroid between the capstan and anchor.

14. The combination of claim 13 wherein:

the first disk of the capstan includes an annular peripheral lip extended outwardly from the flat wall of the first disk, the second disk of the capstan includes an annular peripheral lip extended outwardly from the flat wall of the second disks, the lips of the first and second disks are laterally spaced from each other and guide the cylindroid into the space between the flat walls of the first and second disks during the winding of the cylindroid on the capstan.

15. The combination of claim 13 wherein:

the cylindroid comprises polyester fibers.

16. The overhead bi-fold door of claim 13 wherein:

the cylindroid comprises nylon fibers.

17. An apparatus for opening and closing a passage in a structure with an overhead bi-fold door having a first panel and a second panel pivotally connected for movement from an upright aligned first position closing the passage to a side-by-side folded second position opening the passage in the structure characterized by:

a door lift device operable to selectively move the bi-fold door from the bi-fold door closed first position to the bi-fold door open second position comprising:

a horizontal shaft, supports secured to one of the first panel or the second panel for rotatably holding the shaft, a power transmission drivably connected to the shaft operable to rotate the shaft, motor for operating the power transmission to selectively rotate the shaft in opposite directions, a plurality of capstans secured to the shaft for rotation with the shaft, each capstan including a first disk having a flat first wall, a second disk having a second flat wall, said flat second wall being parallel and laterally spaced from flat first wall, a cylindroid having a first end section located between and in contact with the flat first and second walls of the first and second disks of the capstan and a second end section, anchors secured to the panel opposite the one panel accommodating the supports for the shaft, said capstan upon rotation of the shaft by the power transmission in one direction helically winds the first section of the cylindroid in the space between the flat first and second walls of the first disk and the second disk to move the bi-fold door at an increasing rate of speed from the first position clearing the passage to the second position opening the passage, and upon rotation of the shaft in a direction opposite the one direction the first section of the cylindroid unwinds from the space between the flat first and second walls of the first disk and the second disk to allow the bi-fold door to move at a decreasing rate of speed from the second position to the first position closing the passage in the structure, each anchor including a bracket secured to the panel opposite the one panel accommodating the supports for the shaft, a sleeve rotatably mounted on the bracket, said second end of the cylindroid being connected to and wrapped around the sleeve to adjust the length of the cylindroid between the capstan and the anchor, a ratchet wheel connected to the sleeve, and a latch engageable with the ratchet wheel to prevent rotation of the ratchet wheel and sleeve thereby maintaining the adjusted length of the cylindroid between the capstan and the anchor, said latch being disengaged from the ratchet wheel to allow the ratchet wheel and the sleeve to be rotated to adjust the length of the cylindroid between the capstan and the anchor.

18. The apparatus of claim 17 wherein:

the first disk of the capstan includes an annular peripheral lip extended outwardly from the flat wall of the first disk, the second disk of the capstan includes an annular peripheral lip extended outwardly from the flat wall of the second disks, the lips of the first and second disks are laterally spaced from each other and guide the cylindroid into the space between the flat walls of the first and second disks during the winding of the cylindroid on the capstan.

19. The apparatus of claim 17 wherein:

the polymer fibers of the strands of the cylindroid comprises polyester fibers.

20. The apparatus of claim 17 wherein:

the polymer fibers of the strands of the cylindroid comprise nylon fibers.

* * * * *